United States Patent [19]

Naritomi et al.

[11] Patent Number: 5,065,884

[45] Date of Patent: Nov. 19, 1991

[54] LID OPENER AND CONTAINER USING SAME

[75] Inventors: Hiromi Naritomi, Ebina; Tsutomu Oshida, Yokohama, both of Japan

[73] Assignees: Nissan Motor Co., Ltd.; Nifco Inc., both of Japan

[21] Appl. No.: 456,953

[22] Filed: Dec. 26, 1989

[30] Foreign Application Priority Data

Dec. 28, 1988 [JP] Japan ..... 63-168295[U]

[51] Int. Cl.[5] ..... B65D 43/26

[52] U.S. Cl. ..... 220/264; 220/324; 220/334; 220/343

[58] Field of Search ..... 220/211, 260, 263, 264, 220/334, 343

[56] References Cited

U.S. PATENT DOCUMENTS

| | | | |
|---|---|---|---|
| 722,766 | 3/1903 | Stephenson | 220/264 |
| 1,727,291 | 9/1929 | Judd | 220/264 |
| 2,325,897 | 8/1943 | Waltman | 220/264 |
| 2,328,833 | 9/1943 | Moon et al. | 220/264 |
| 2,581,892 | 1/1952 | White | 220/264 X |
| 2,639,113 | 5/1953 | Kriz | 220/264 X |
| 4,809,867 | 3/1989 | Choi | 220/211 |

FOREIGN PATENT DOCUMENTS 58-102350 7/1983 Japan .

*Primary Examiner*—Stephen Marcus
*Assistant Examiner*—Nova Stucker
*Attorney, Agent, or Firm*—Leydig, Voit & Mayer

[57] ABSTRACT

A lid opener comprises a frame having a first axis and a second axis which extend substantially in parallel. A first member is integrally moveable with the lid for rotation about the first axis. A second member is in engagement with the first member and rotatable about the second axis. Means are provided for driving the second member for rotation in such a predetermined direction as to move the first member in such a direction as to open the lid, and are constructed and arranged as to allow movement of the first and second members during closing movement of the lid.

7 Claims, 3 Drawing Sheets

LID OPENER AND CONTAINER USING SAME

BACKGROUND OF THE INVENTION

The present invention relates to a lid opener, and also to a container using a lid opener.

Japanese Utility Model Publication No. 58-102350 discloses a lid opener wherein a plastic lid is mounted on a container via an axis, and automatically opened owing to the force of a spring.

With such a prior art, however, since the lid or its axis is always subjected to the force of the spring, a stress due to the force is placed on the lid or the its axis, causing a deformation of the lid. Such deformation is particularly considerable when the lid is used in a site where the temperature may go up to a high level (about 110° C.).

Further, since the lid or its axis is subjected to the force of the spring, the lid opens too quickly. Thus, the axis of the lid receives a great shock, resulting in damage and/or deformation of a portion which the axis is associated with.

An object of the present invention is to provide a lid opener and a container using the same wherein the lid or its axis is not subjected to a stress.

Another object of the present invention is to provide a lid opener and a container using the same wherein a lid does not open too quickly.

SUMMARY OF THE INVENTION

According to one aspect of the present invention, there is provided a lid opener for opening a lid, comprising:

a frame having a first axis and a second axis which extend substantially in parallel;

a first member integrally moveable with said lid for rotation about said first axis;

a second member in engagement with said first member and rotatable about said second axis; and means for driving said second member for rotation in such a predetermined direction as to move said first member in such a direction as to open the lid, said means being constructed and arranged as to allow movement of said first and second members during closing movement of the lid.

According to another aspect of the present invention, there is provided a container comprising:

means for defining an opening;

a frame on said opening defining means and extending around said opening;

a lid having one end mounted to said frame for rotatable movement about a first axis between a closed position where said lid engages with said o frame to close said opening and a fully open position where said lid opens said opening;

a first member integrally moveable with said lid for rotation about said first axis;

a second member in engagement with said first member and rotatable about a said second axis which extends in substantially in parallel to said first axis; and means for driving said second member for rotation in such a predetermined direction as to move said first member in such a direction as to open the lid, said means being constructed and arranged as to allow movement of said first and second members during closing movement of the lid; and means for releasably locking said lid in said closed position.

DETAILED DESCRIPTION OF THE INVENTION

Referring now to FIGS. 1 to 4, there is described a preferred embodiment of the present invention.

Figure 2:
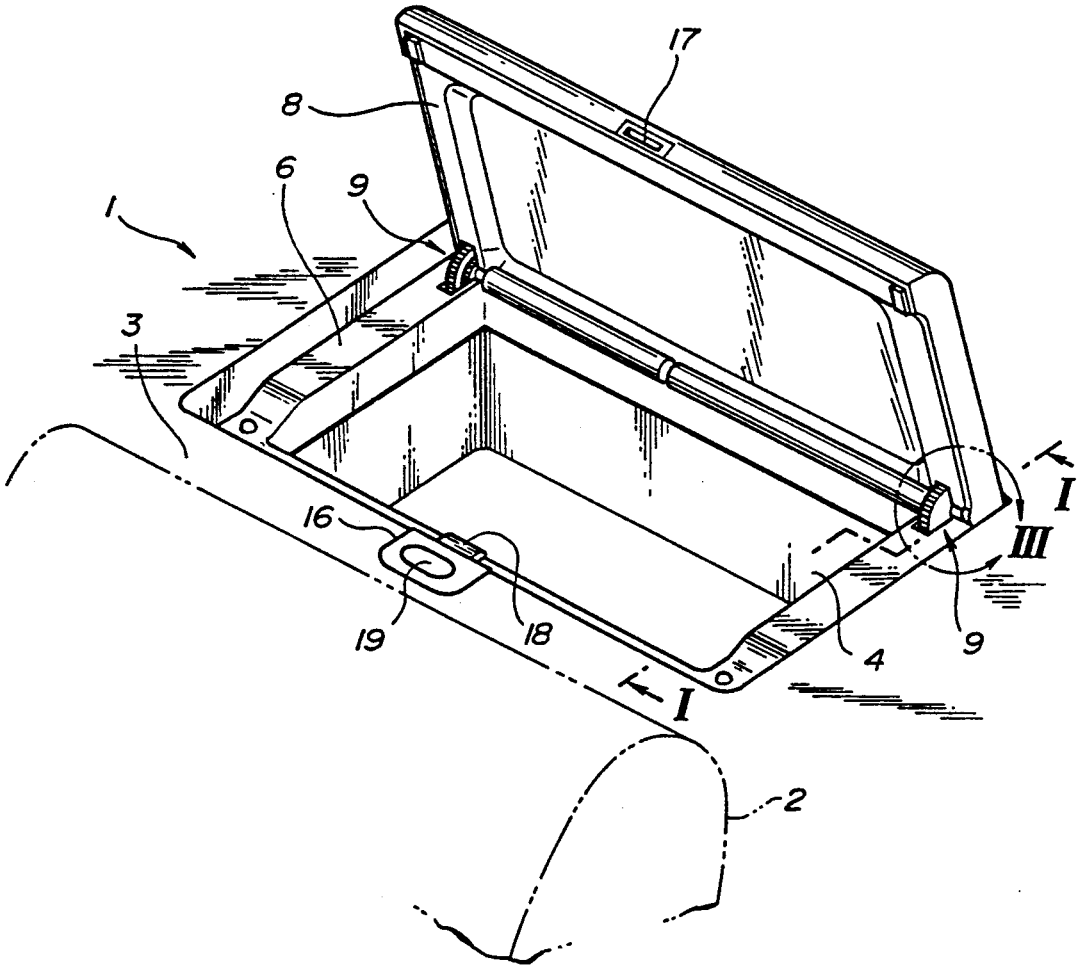
FIG. 2 is a perspective view of the container with lid opened.

As best seen in FIG. 2, a container 1 is arranged in a rear parcel shelf 3 located at the rear of a rear seat 2 of an automotive vehicle. The container 1 includes a box 4, a lid 8, and a frame 6. The frame 6 is disposed on an opening of the box 4. The lid 8 is rotatable with a shaft 7 during opening and closing movement relative to the frame 6.

Figure 1:
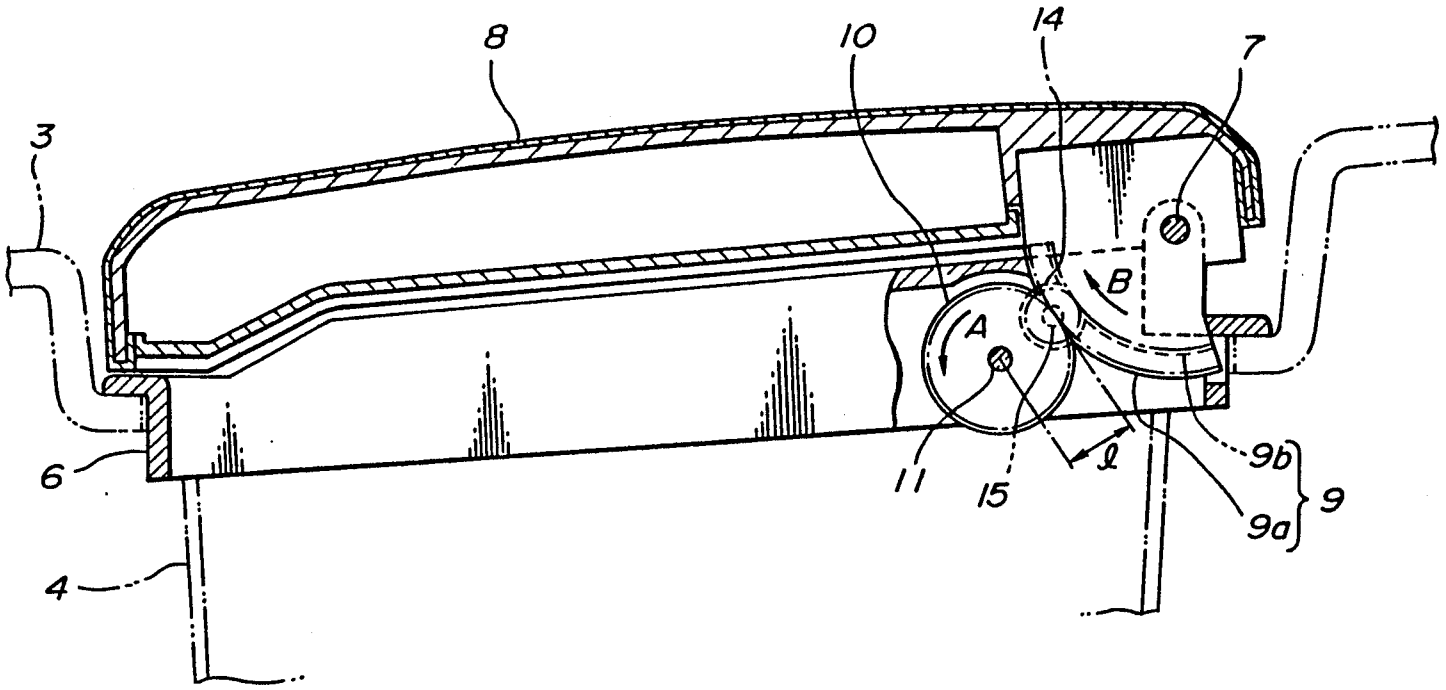
FIG. 1 is a cross-sectional view of a preferred embodiment of a container with lid closed taken along the line I—I of FIG. 2.
Figure 3:
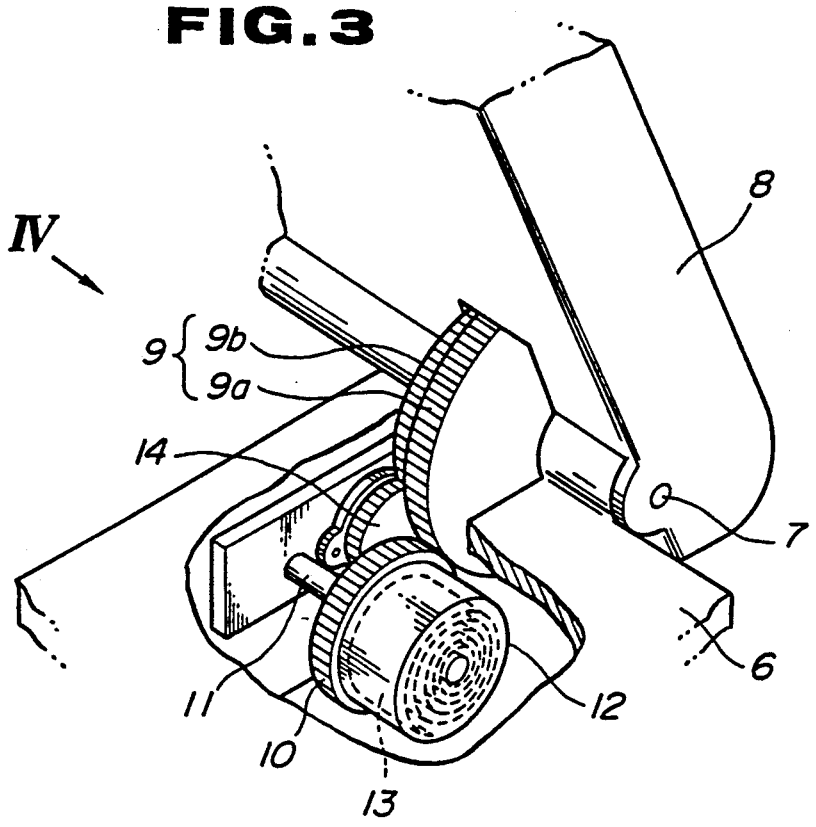
FIG. 3 is an enlarged, partially broken detail, showing a portion illustrated by an arrow III of FIG. 2.
Figure 4:
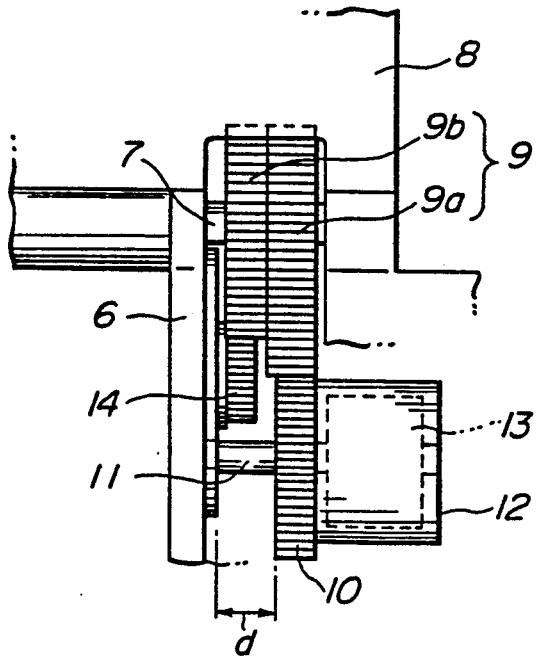
FIG. 4 is a side view as viewed from an arrow IV of FIG. 3.

Sectors 9 are fixedly mounted to the shaft 7 at both ends thereof for integral movement with the lid 8. As best seen in FIG. 3, each of the sectors is formed with a relatively large diameter teeth portion 9*a* and a relatively small diameter teeth portion 9*b*. A pinion gear 10 is mounted to a second shaft 11 which has one end supported by the frame 6, and the other end coupled to a flat spiral spring 13 disposed in a casing 12. As best seen in FIG. 4, the pinion gear 10 is meshed with the large diameter teeth portion 9*a* and it is spaced a distance d from the frame 6. The casing 12 of the flat spiral spring 13 is attached to the frame 6. Referring to FIG. 1, the flat spiral spring 13 urges the second shaft 11 and thus the pinion gear 10 to rotate in a direction as indicated by an arrow A so as to rotate the sector 9 in a direction as indicated by an arrow B. This movement of the sector 9 allows the lid 8 to open upwardly.

As best seen in FIG. 4, a brake wheel 14 is disposed adjacent the pinion gear 10, and meshed with the relatively small diameter teeth portion 9*b* of the sector 9. The brake wheel 14, which is subjected to a predetermined braking force to restrict its movement, is meshed with the small diameter teeth portion 9*b* so as to control opening motion of the lid 8. As best seen in FIG. 1, a third shaft 15 which the brake wheel 14 is fixedly coupled with is displaced from the second shaft 11 by a distance 1(el). The braking force applied to the brake wheel 14 acts to restrict motion of the pinion gear 10 via the sector 9. As best seen in FIG. 2, there is provided a lock mechanism 16 in the middle of the front end of the frame 6. Upon closing the lid 8, a stop 18 of the lock mechanism 16 is engaged with a groove 17 formed in the lid 8 at a portion corresponding to the lock mechanism 16 thus keeping the lid 8 closed. The stop 18 withdraws by manually pressing a press button 19, releasing the stop 18 from the groove 17.

The operation is now described. Upon opening the lid 8, the button 19 of the lock mechanism 16 is pressed. Then, the locking engagement of the stop 18 with the groove 17 is released, and the pinion gear 10 begins to move in the direction as indicated by the arrow A owing to the force of the flat spiral spring 13, causing movement of the sector 9 in the direction as indicated by the arrow B. This movement of the sector 9 allows the lid 8 to open upwardly. In this event, since the braking force of the brake wheel 14 is applied to the sector 9 vis the meshing engagement with the small diameter teeth portion 9*b*, the opening movement of the lid 8 decelerated. Accordingly, the opening movement of the lid 8 with a high-grade feel can be realized, resulting in increased commercial value of the container 1. Further, since the lid 8 does not open too quickly, the shaft 7 of the lid 8 does not receive a shock, preventing damage and/or deformation thereof. On the other hand, upon closing the lid 8, the lid 8 is manually pressed downwardly until the groove 17 of the lid 8 is locked with the stop 18 of the lock mechanism 16. In this event, the flat spiral spring 13 is wound to store force for a subsequent opening of the lid 8.

When the lid 8 is closed, the restored force of the flat spiral spring 13 is applied to the lid 8 via the sector 9 in a dispersive manner, so that the lid 8 or the shaft 7 is not subjected to a stress. Additionally, since the shaft 15 of the brake wheel 14 is displaced from the shaft 11 of the pinion gear 10 by distance 1(el), the shaft 11 also is not directly subjected to the braking force of the brake wheel 14, removing a stress from the pinion gear 10. Accordingly, arranged at a site such as the rear parcel shelf 3 of the automotive vehicle where the temperature may go up to a high level (about 110° C.) by solar heat, the container 1 can not be deformed thermally.

In this embodiment, the brake wheel 14 is meshed with the sector 9. The shaft 15 of the brake wheel 14 may merely be displaced from the shaft 11 of the pinion gear 10. Accordingly, the brake wheel 14 may be meshed with the pinion gear 10 directly, bypassing the sector 9.

What is claimed is:

1. A lid opener for opening a lid, comprising:

a frame having a first axis and a second axis which extend substantially in parallel;

a first member integrally moveable with said lid for rotation about said first axis, said first member being in the form of a sector;

a second member in engagement with said first member and rotatable about said second axis, said second member being a gear meshed with said sector; and means for driving said second member for rotation in such a predetermined direction as to move said first member in such a direction as to open the lid, said means being constructed and arranged as to allow movement of said first and second members during closing movement of the lid:

said driving means including a flat spiral spring operatively connected between said second member and said frame about said second axis.

2. A lid opener as claimed in claim 1, wherein said driving means include means for slowing motion of said sector.

3. A lid opener as claimed in claim 2, wherein said sector including a relatively large diameter portion meshed with said gear and a relatively small diameter portion, and wherein said slowing means include a brake wheel meshed with said relatively small diameter portion.

4. A container comprising:

means for defining an opening;

a frame on said opening defining means and extending around said opening;

a lid having one end mounted to said frame for rotatable movement about a first axis between a closed position where said lid engages with said frame to close said opening and a fully open position where said lid opens said opening;

a first member integrally moveable with said lid for rotation about said first axis;

a second member in engagement with said first member and rotatable about said second axis which extends in substantially in parallel to said first axis; and means for driving said second member for rotation in such a predetermined direction as to move said first member in such a direction as to open the lid, said means being constructed and arranged as to allow movement of said first and second members during closing movement of the lid;

said driving means including a flat spiral spring operatively connected between said second member and said frame about said second axis; and means for releasably locking said lid in said closed position.

5. A container as claimed in claim 4, wherein said first member is in the form of a sector, and said second member is a gear meshed with said sector.

6. A container as claimed in claim 5, wherein said driving means include means for slowing motion of said sector.

7. A container as claimed in claim 6, wherein said sector including a relatively large diameter portion meshed with said gear and a relatively small diameter portion, and wherein said slowing means include a brake wheel meshed with said relatively small diameter portion.

* * * * *